United States Patent [19]

Reinert et al.

[11] Patent Number: 4,592,785

[45] Date of Patent: Jun. 3, 1986

[54] PROTEINACEOUS SOIL REMOVAL PROCESS

[75] Inventors: Raymond L. Reinert; Charles D. Kaufman, both of Louisville, Ky.

[73] Assignee: General Electric Company, Louisville, Ky.

[21] Appl. No.: 702,870

[22] Filed: Feb. 21, 1985

Related U.S. Application Data

[63] Continuation of Ser. No. 561,954, Dec. 15, 1983, abandoned.

[51] Int. Cl.[4] ..... B08B 7/04

[52] U.S. Cl. ..... 134/18; 134/25.2; 134/113; 134/56 D; 134/57 D

[58] Field of Search ..... 134/18, 25.2, 56 D, 134/57 D, 113

[56] References Cited

U.S. PATENT DOCUMENTS

| | | | |
|---|---|---|---|
| 1,870,318 | 8/1932 | Stoddard . | |
| 2,042,347 | 5/1936 | Mackenzie | 87/5 |
| 2,155,923 | 4/1939 | Armstrong | 99/231 |
| 2,500,042 | 3/1950 | Nutting, Jr. et al. | 23/253 |
| 2,572,576 | 10/1951 | Stybel | 134/3 |
| 2,746,466 | 5/1956 | Clague et al. | 134/72 |
| 2,968,172 | 1/1962 | Johnson | 68/17 |
| 3,160,317 | 12/1964 | Hambro | 222/1 |
| 3,319,637 | 5/1967 | Gore et al. | 134/113 X |
| 3,672,821 | 6/1972 | Schlussler | 21/2.7 |
| 3,677,821 | 7/1972 | Tanaka | 134/42 |
| 3,682,190 | 8/1972 | Patil et al. | 134/57 R X |
| 3,746,506 | 7/1973 | Aitken et al. | 8/108 |
| 3,833,419 | 9/1974 | Weiss | 134/42 |
| 3,847,663 | 11/1974 | Shumaker | 134/2 |
| 3,896,827 | 7/1975 | Robinson | 134/10 |
| 3,997,459 | 12/1976 | Bogie et al. | 252/99 |
| 4,116,851 | 9/1978 | Rupe et al. | 134/2 X |
| 4,334,881 | 6/1982 | Reinert et al. | 23/230 |

*Primary Examiner*—Jeanette Hunter

*Attorney, Agent, or Firm*—Frederick P. Weidner; Radford M. Reams

[57] ABSTRACT

A process for automated and improved proteinaceous soil removal in a wash water solution wherein alkali is first added to the wash water solution to bring the pH thereof to slightly below a selected target pH value in the range of 10 to 11 that will be effective to react with and solubilize the proteinaceous soil. To that wash water solution 5 to 50 milligrams of hypohalous halogen per liter of wash water solution and sufficient alkali is added to raise the pH of the wash water solution to the target pH value. The wash water solution is monitored to detect a drop in pH of at least 0.02 pH units occurring after the addition of the hypohalous halogen. If there is no such drop in pH then the process is terminated. If there is at least a 0.02 pH units drop in pH then an incremental amount of hypohalous halogen and sufficient alkali are added to the solution to again raise the pH of the water solution to the target pH. This cycle continues until there is less then 0.02 pH units drop thereby insuring substantially complete reaction with the proteinaceous soil.

11 Claims, 3 Drawing Figures

PROTEINACEOUS SOIL REMOVAL PROCESS

This application is a continuation of application Ser. No. 561,954, filed Dec. 15, 1983 abandoned.

BACKGROUND OF THE INVENTION

The present invention relates generally to processes for removing proteinaceous soils in a wash water solution and, more particularly, for an automated and improved proteinaceous soil removal process in a wash water solution using process-controlled additions of incremental amounts of hypohalous halogen that may be supplied in the form of a hypohalite bleach.

Proteinaceous soils are recognized as being one of the most difficult types of soils to remove using an aqueous wash. Insufficient removal of proteinaceous soils from objects washed in a wash water solution is both unsatisfactory and unsightly, especially when the proteinaceous soil is highly visible to the user, as is the case with cooked egg.

Prior art approaches for removing proteinaceous soil typically employ high detergent levels in the wash water solution. These detergent levels are preselected so as to be above the highest needed level to produce satisfactory proteinaceous soil removal irrespective of variations in the wash water solution supply and the proteinaceous soil load. Prior art proteinaceous soil removal processes typically employed fixed detergent levels and cannot respond dynamically to variations inherently present between one wash load and the next.

Proteinaceous soil removal is especially important in the dishwasher environment, both commercial and domestic. Presently available dishwasher detergents often include an organic surface active agent and chlorine carrier component the later of which is added for two purposes: to help assure clear glassware, and to help assure sanitation.

It is known that hypohalites introduced into a wash water solution will react and solubilize the proteinaceous soils present on the objects being washed. The mechanism of the protein-hypohalite reaction is not well defined. It is believed, however, that the Hofmann Reaction is probably involved, whereby an amide is converted to an amine with one less carbon atom. This conversion is repeated many times on the protein's peptide bonds, which gradually reduces the size of the protein's chain length, thereby making the final product more soluble.

Several major problems exist, however, with the use of a hypohalite for removal of proteinaceous soils from objects being washed in a wash water solution. When the level of available hypohalite is very low, which, as is explained below, is the case when conventional dishwashing detergents are used, no appreciable solubilization of protein occurs in the time period that the wash cycle using the detergent takes place because all of the available hypohalite is rapidly consumed. The level of the hypohalite component (typically a chlorine carrier component) in a conventional dishwashing detergent is generally less than two percent of the formulation in order to retard sufficiently the reaction between the hypohalite carrier and the organic surface active agent present in the detergent composition.

The second problem associated with the use of hypohalites in a process for removing proteinaceous soils is that if a single fairly large amount of hypohalite is added to the wash water solution to be effective, unsatisfactory and deleterious side effects result to plastic and soft metal objects being washed. Specifically, the hypohalite blackens silver and causes pitting of aluminum. Since the actual proteinaceous soil level is uncontrollable from dishwasher load to dishwasher load, it is difficult to set a delivery rate for a hypohalite such that the beneficial effects of hypohalite could be achieved while assuring that the undesirable side effects were avoided on plastics and soft metals, such as silver and aluminum.

By this invention there is provided a process for washing articles bearing proteinaceous soil that will automatically provide the correct amount of hypohalite to effectively remove the soil that will vary in amount from one dishwasher load to another yet not detrimentally affect plastic and soft metal articles in the dishwasher load.

SUMMARY OF THE INVENTION

The present invention is a process for automated and improved proteinaceous soil removal in a wash water solution using incremental amounts of hypohalous halogen, usually supplied in the form of hypohalite bleach, in accordance with pH control. In the process of the present invention, the proteinaceous soil is solubilized by the hypohalous halogen. The deleterious effects to the articles being washed by the introduction of a single amount of hypohalous halogen sufficient to remove the proteinaceous soil from the articles is avoided without affecting solubilization by adding the hypohalous halogen in incremental amounts while sensing pH of the washer water solution. The first step of the process is to add alkali to the wash water solution to bring the pH thereof to slightly below a selected target pH value in the range of 10 to 11 that will be effective to solubilize the protein. Thereafter 5 to 50 milligrams of hypohalous halogen per liter of wash water solution is added and sufficient alkali to raise the pH of the wash water solution to the target pH value. The pH value of the wash water solution is monitored to detect a drop in pH from the target pH value of at least 0.02 pH units after the addition of the hypohalous halogen. If there is no such drop in pH of the wash water solution, then incremental additions of the hypohalous is terminated. If, however, thee is a 0.02 pH unit drop then, concurrently, an incremental amount of 5 to 50 milligrams of hypohalous halogen per liter of wash water solution and sufficient alkali is again added to the wash water solution to raise the pH thereof to the target pH value. This cycle will continue for a reasonable amount of the time until the 0.02 pH units drop is no longer detected thereby insuring substantially complete reaction with the proteinaceous soil. With this process not only is the proteinaceous soil removed from the articles being washed but there are no serious effects on plastic, silverware or aluminum because the concentration of available hypohalous halogen in the wash water solution is always kept below the level which produces the adverse side effects with these types of articles.

DETAILED DESCRIPTION OF THE INVENTION

Figure 1:
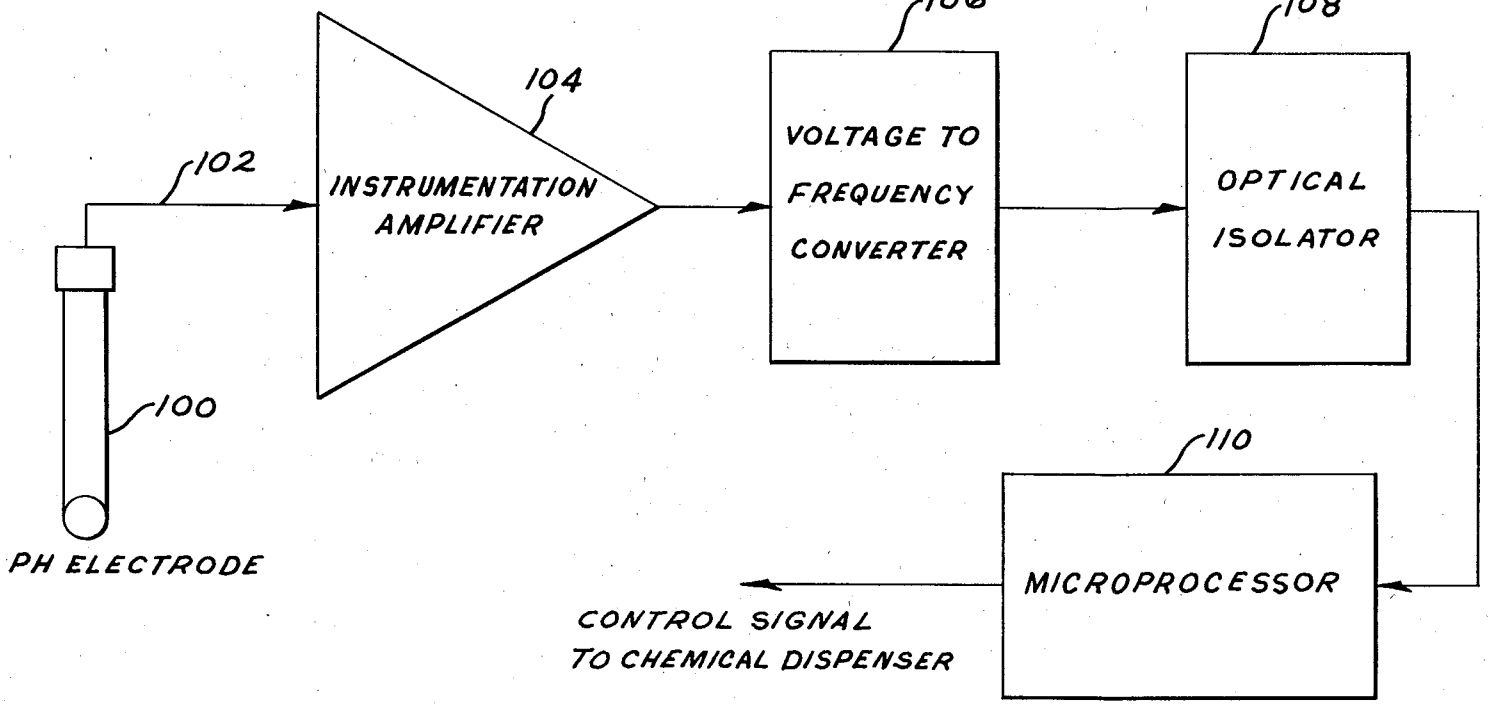
FIG. 1 is a simplified electrical block diagram of one embodiment of an apparatus for implementing the process of the present invention.

The process of the present invention provides for automated and improved proteinaceous soil removal in a wash water solution by using hypohalous halogen that can be supplied by a conventional household hypohalite bleach or preferably an alkaline-built hypohalite bleach, which is dispensed in incremental amounts in accordance with pH control. The process of the present invention is based upon the reduction in pH of an alkaline wash water solution which occurs when hypohalite is added in incremental amounts thereto only as long as there is unsolubilized proteinaceous soil remaining on the articles being washed.

Prior to the addition of the hypohalite thereto, the pH of the wash water solution is first raised using an alkali, such as sodium hydroxide or sodium carbonate or an alkaline salt, to a preselected first pH value, which is slightly less than a target pH of the process, which is in the range of from 10 to 11, for example, 10.5 that will be effective for reaction to solubilize the protein. The preselected first pH value is slightly less than the target pH value, e.g., from 0.05 to 0.1 units less.

After the pH of the wash water solution has been raised by the addition of alkali to the preselected first pH value, an incremental amount of alkali and 5 to 50 milligrams of hypohalous halogen per liter of wash water solution supplied by conventional hypohalite bleach are concurrently added to the wash water solution until the target pH value is reached. This will occur very rapidly if there is no proteinaceous soil to be solubilized. The alkali may be added separately together with the hypohalite bleach or as an alkaline-built hypohalite bleach which in effect combines the two compounds. As used herein when alkali and hypohalous halogen are added to the wash water solution it can be done in either of these manners. After the target pH value has been reached, the pH of the wash water solution is continuously monitored. If the pH value drops by a preselected amount (for example, 0.02 pH units) below the target pH value after the addition of the incremental amount of hypohalite bleach, incremental amounts of alkali and hypohalite bleach are again added to the wash water solution. This drop in pH after each hypohalite addition ceases after substantially all of the proteinaceous soil has been solubilized, and indicates that the process of the present invention should be terminated. No adverse side effects to plastic or soft metal objects being cleaned are observed in the process of the present invention because the hypohalite level is maintained below the level which produces adverse effects, but is maintained at a sufficient level so that the solubilization reaction occurs at an acceptable rate.

A wide variety of the alkalis and alkaline salts are suitable for maintaining the desired pH, including alkali metal hydroxide carbonates, silicates and phosphates. They can be added in solid form or preferably as aqueous solutions, e.g., at concentrations of 0.8-8.0N. Silicate solutions or solutions of potassium hydroxide are especially suitable; ammonia and its derivatives should be avoided since they are reactive with hypohalite. The preferred alkali is sodium metasilicate because this alkaline salt exhibits detergency and also protects aluminum. Other silicates can be beneficial in protecting aluminum (e.g., silicates with $SiO_2$:$Na_2O$ ratio between 2 and 3) and may be used as substitutes for sodium metasilicate or in combination with sodium metalsilicate or some other alkali.

The process of the present invention is based upon the reduction in pH below the target pH level of the wash water solution which occurs each time an incremental amount of hypohalite is added thereto until substantially all of the proteinaceous soil has been solubilized. By monitoring this reduction in pH from the target pH level, the process of the present invention allows the hypohalite level of the wash water solution always to be maintained below a level which results in detrimental side effects to the objects being washed, but at a level high enough to assure that the reaction rate of solubilization is practicable. As test results presented below show, the process of the present invention results in a substantial increase in the level of cleaning of proteinaceous soil, without the detrimental side effects which would occur if the hypohalite was introduced in a single amount at the beginning of the cleaning process.

Aqueous sodium hypochlorite, e.g., at concentrations of 2,000 to 70,000 parts per million (ppm) available chlorine is an example of an hypohalite suitable for use in the process of the present invention. Aqueous sodium hypochlorite having 5,000 to 50,000 ppm available $Cl_2$ is used in the examples below, but it should be understood that this is only for purposes of illustration.

Beaker tests have shown that neither grease (in the form of margarine) nor carbohydrate (in the form of starch) consume hypochlorite or cause a sustained pH reduction.

It has been found advantageous for simplicity of the process to combine the hypohalite with an alkali in the form of an alkaline-built bleach. The addition of alkali to the hypohalite is a desirable way of regulating the amount of hypohalite added incrementally when the alkali is added to return the pH to the target value. For instance, based on silicate as the alkali, $SiO_2$:$Na_2O$ ratio between 1:1 and 1.6:1 and used in the range 30–50 grams per liter, the molar ratio of alkali to hypochlorite is preferably from 0.2:1 to 14:1 and, more preferably, about 0.6:1 to 2.0:1.

Silicate concentrations of 30 grams per liter, 40 grams per liter, and 50 grams per liter have been employed satisfactorily for alkaline-built bleaches. In the case of an alkaline-built bleach having a silicate concentration of 40 grams per liter, chlorine bleaches in the rage of 5,000–50,000 milligrams per liter of available chlorine have been found to be satisfactory.

In carrying out the process of this invention, the hypohalite is preferably added in increments which supply from about 15 to 20 milligrams of hypohalite halogen per liter of wash water solution. In these amounts, the concentration of hypohalite in the wash water solution can readily be maintained below 60 milligrams per liter, above which concentration damage to plastic, aluminum and silver articles in the wash water solution can occur.

The alkali is also added incrementally, concurrently with each increment of hypohalite, either separately or in the form of an alkaline-built bleach, in an amount required to bring the pH of the wash water solution to the target pH value. The amount of alkali incrementally added to the wash water solution can be varied depending upon the amount of proteinaceous soil present. For instance, it may be desirable to add a greater amount of alkali per increment when the pH unit drops substantially below 0.02 pH units and then lesser amounts when the pH unit drop is not substantially below 0.02 pH units.

When the hypohalite bleach and alkali are added as a mixture, necessarily, the respective amounts of the two ingredients therein must be such that about 15 to 20 milligrams of hypohalite halogen per liter of wash water solution will be supplied thereto in the volume of the mixture of alkali and hypohalite required to return the pH of the wash water solution to the target pH value. For example, if conventional household bleach is used (5.25% hypochlorite), it should contain an amount of alkali or alkaline salt equivalent to about 0.8 grams to 1.7 grams of KOH per liter.

When the hypohalite and alkali are added separately, they should be added concurrently with both additions starting and terminating simultaneously in response to a signal generated by the pH detector when the pH of the wash water drops at least 0.02 pH units below the target pH value and when it reaches the target pH value, respectively. The proper proportion of hypohalite to alkali can be achieved by regulating the respective concentrations thereof in the solutions in which they are dispensed and/or by their respective flow rates during the period of addition.

An embodiment of the apparatus for implementing the process of the present invention is shown in block diagram form in FIG. 1. It should be understood that this embodiment is only illustrative and that any apparatus could be employed to implement the process of the present invention if the apparatus is capable of accurately sensing the pH of the wash water solution being controlled and is capable of controlling the dispensing of first alkali and they hypohalite bleach and alkali to the wash water solution in accordance with the sensed pH and the desired target pH value.

Turning now to FIG. 1, a combination pH/reference electrode 100 is mounted so as to be in continuous fluid contact with the wash water solution whose pH value is being continuously measured. The pH reference electrode 100 provides on an output lead 102 an electric signal having a voltage amplitude proportional to the pH value being sensed. The pH electrode 100 is of conventional design, and may, for example, be a glass bulb pH electrode having a source impedance which can range up to $10^{13}$ ohms. As is well known, such a glass bulp pH electrode provides on its output line 102 an output voltage of very low amplitude.

An instrumentation amplifier 104 is provided to amplify the low level voltage signal on line 102, and to provide this amplified voltage as an output signal to the input of a voltage-to-frequency converter 106. Instrumentation amplifier 104 is of conventional design, and any one of many commercially available units could be satisfactorily employed. When pH electrode 100 is of the glass bulb electrode variety, it is essential that instrumentation amplifier 104 have a very high input impedance so as to prevent amplifier 104 from drawing excessive current from the electrode and thereby causing erroneous data. A suitable instrumentation amplifier 104 which exhibits a very high input impedance would be one employing junction field effect transistors (JFETs) as the input amplifying devices. The gain of instrumentation amplifier 104 must be sufficient so that the output signal from amplifier 104 is capable of driving the voltage-to-frequency converter 106.

Voltage-to-frequency converter 106 converts the output signal from amplifier 104 to a digital bit stream having a bit rate proportional to the voltage level of the output signal from amplifier 104. To put it in other terms, voltage-to-frequency converter 106 converts the signal from amplifier 104 to a digital bit stream whose bit frequency is proportional to the voltage amplitude level of the output signal from amplifier 104. Voltage-to-frequency converter 106 is of conventional design, and any one of many commercially available units can be used.

The digital bit stream output from voltage-to-frequency converter 106 is applied to the input of an optical isolator 108. Optical isolator 108 provides an output digital signal having a bit rate which is identical to the bit rate of the input digital signal. The output digital bit stream from optical isolator 108 is provided to the input of a microprocessor 110. Optical isolator 108 is necessary to prevent ground loops that could develop between the ground lead of microprocessor 110 which is at earth ground reference, and the wash water solution under pH test, which could also have electrical paths to earth ground through the solution container (not shown) or even through the water lines connected to the solution container (not shown). Optical isolator 108 is of conventional design, and any one of the many commercially available units can be used.

Microprocessor 110 accepts as an input the digital bit stream output provided by optical isolator 108. Microprocessor 110 is of conventional design, and is programmed using any one of the available approaches, i.e., softward, firmware or hardware to provide an appropriate control signal to the chemical dispensers of conventional design (not shown), which dispense on signal command an amount of alkali and hypohalite bleach (which may be alkaline-built bleach) to the wash water solution. As is discussed in greater detail below, microprocessor 110 is programmed to provide control signals to the chemical dispensers in accordance with the bit rate of the digital bit stream from optical isolator 108 so that the process of the present invention is carried out within specified pH levels for selected time periods irrespective of variations in the chemical composition of the wash water solution and the proteinaceous soils being solubilized.

Figure 2:
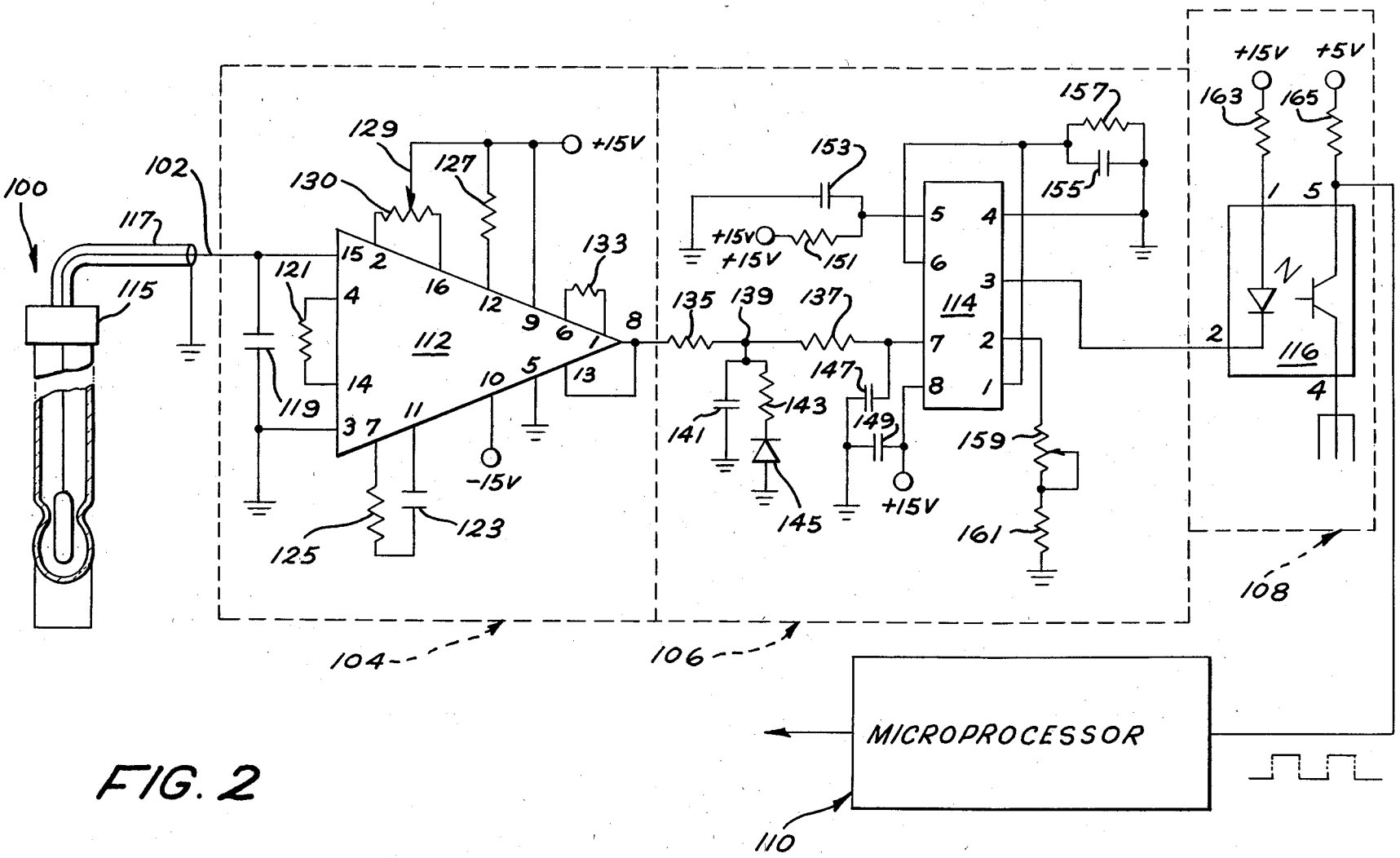
FIG. 2 is a schematic diagram of the embodiment of FIG. 1.

Referring now to FIG. 2, a schematic diagram of an actual circuit which produces the functions shown in the block diagram of FIG. 1 is depicted. The structure of glass bulb pH electrode 100 is shown partly in cross section, and its electrode cap 115 is connected electrically to an outer sheath 117 provided around output lead 102. Sheath 117 is connected to circuit ground, which is not earth ground, approximately at the point where output lead 102 is connected to terminal 15 of instrumentation amplifier stage 104.

Instrumentation amplifier stage 104 includes an instrumentation amplifier module 112 of conventional design having JFETs as the input active devices. Instrumentation amplifier module 112 exhibits a very high input impedance because of the JFETs.

A capacitor 119 is connected between terminal 15 of instrumentation amplifier module 112 and terminal 3 and circuit ground. A resistor 121 is connected between terminal 4 and terminal 14; a capacitor 123 in series connection with resistor 125 is connected between terminal 11 and terminal 7.

A positive voltage source (not shown) having, for example, a voltage level of +15 volts is connected directly to terminal 9 of instrumentation amplifier module 112, is connected via a resistor 127 to terminal 12, and is also connected to wiper arm 129 of a potentiometer 130 whose other two arms are connected to terminals 2 and 16, respectively. A negative voltage source (not shown) having, for example, a voltage level of −15 volts is connected directly to terminal 10.

A resistor 133 is connected between terminals 6 and 1 of instrumentation amplifier module 112. The output line to the voltage-to-frequency converter 106 is connected to terminal 8 and to terminal 13 of instrumentation amplifier module 112.

Voltage-to-frequency converter 106 includes a voltage-to-frequency module 114. The output analog signal from instrumentation amplifier stage 104 is connected to the input of the voltage-to-frequency module 114 via a resistor 135 and a resistor 137 in series connection. Specifically, one lead of resistor 135 is connected to terminals 8 and 13 of instrumentation amplifier module 112, while the other lead is connected to a lead of resistor 137 at a node 139. The other lead of resistor 137 is connected to terminal 7 of voltage-to-frequency module 114. A capacitor 141 is connected from node 139 to circuit ground. A resistor 143 has one lead connected to node 139 and a second lead connected to the cathode of a diode 145. The anode of diode 145 is, in turn, connected to circuit ground.

A capacitor 147 is connected between terminal 7 and circuit ground. A positive voltage source (not shown) having, for example, a voltage level of +15 volts is connected to terminal 8, and a capacitor 149 is connected between terminal 8 and circuit ground. The positive voltage source is also connected via a resistor 151 to terminal 5. A capacitor 153 is connected between terminal 5 and circuit ground.

Terminal 4 is directly connected to circuit ground. A capacitor 155 and a resistor 157 in parallel connection are connected between circuit ground and terminals 1 and 6. Terminal 2 is connected to one of the arms of a potentiometer 159, whose second arm is connected to its wiper arm. The second arm, in turn, is connected to one lead of a resistor 161, whose other lead is connected to circuit ground.

As was explained above, voltage-to-frequency converter 106 converts the analog output signal from instrumentation amplifier stage 104 to a digital bit stream whose bit rate corresponds to the voltage level of the analog output signal. This output digital bit stream present on terminal 3 of the voltage-to-frequency module 114 is in turn connected at terminal 2 of an optical isolator module 116 of isolator stage 108.

Terminal 2 of opto-isolator module 116 is connected to the cathode of the internal light emitting diode. The anode of the internal light emitting diode is connected to terminal 1 of module 116, while the emitter of the light responsive internal transistor is connected to terminal 4 and the collector is connected to terminal 5.

Terminal 1 is connected via a resistor 163 to the positive voltage source having, for example, a voltage level of +15 volts. Terminal 5, which is the output terminal providing the ground loop isolated digital bit stream output, is connected via a resistor 165 to a second positive voltage source (not shown) having, for example, a voltage level of +15 volts. Terminal 4 is connected to earth ground and is also connected to the voltage return path of the second positive voltage source.

The output digital bit stream present at terminal 5 of optoisolator module 116 is provided to the input port of microprocessor 110. Representative logical operations performed by microprocessor 110 are discussed blow; for present purposes, it is sufficient to note that the output control signal provided by microprocessor 110 is provided to the chemical dispensers (not shown) to control the selected dispensing of the alkali and bleach (which may be alkaline-built bleach) to the wash water solution.

Table 1 below shows representative electrical component values as well as commercial sources, if applicable, of the electrical component shown in the circuit of FIG. 2.

TABLE 1

| | |
|---|---|
| Glass Bulb pH Electrode | Model Orion 91-05-00 combination pH/reference electrode |
| Instrument Amplifier Module 112 | Model #LF352 from National Semiconductor |
| Capacitor 119 | .02 F |
| Resistor 121 | 15K |
| Capacitor 123 | .0022 F |
| Resistor 125 | 150 |
| Resistor 127 | 4.7K |
| Potentiometer 131 | 10K |
| Resistor 133 | 1 M |
| Voltage to Frequency Module 114 | Model #4151 from Raytheon |
| Resistor 135 | 10K |
| Resistor 137 | .1 M |
| Capacitor 141 | 10 F |
| Resistor 143 | 100 |
| Diode 145 | |
| Capacitor 147 | .01 F |
| Capacitor 149 | .1 F |
| Resistor 151 | 6.8K |
| Capacitor 153 | .01 F |
| Capacitor 155 | 1 F |
| Resistor 157 | .1 M |
| Potentiometer 159 | 5K |
| Resistor 151 | 62K |
| Opto-Isolator Module 116 | Model #H11A1 from General Electric |
| Resistor 163 | 470 |
| Resistor 165 | 1K |
| Microprocessor 110 | Model F8 from MOSTEK |

Figure 3:
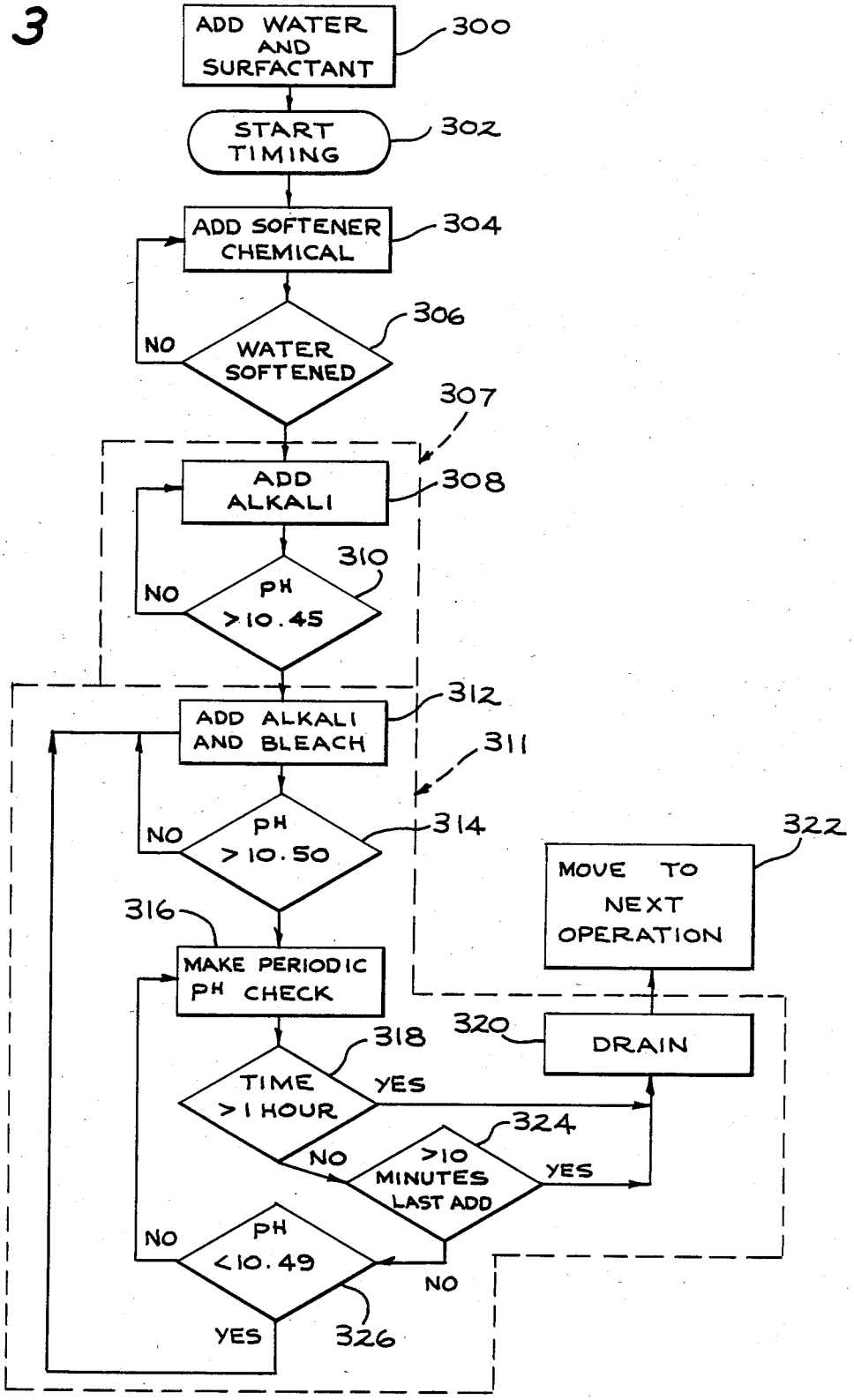
FIG. 3 is a detailed flow chart showing the logic operational steps by microprocessor 110 of FIG. 2 for an example application where microprocessor 110 is used to control the hypochlorite level of the wash water of a home dishwasher in accordance with the process of the present invention.

FIG. 3 is a flow chart showing the logic operational steps performed by microprocessor 110 for an example application where microprocessor 110 is being used to control the pH level of the wash water solution of a dishwasher in accordance with the process of the present invention.

Turning now to FIG. 3, microprocessor 110 of FIGS. 1 and 2 is programmed first to cause wash water and a dishwasher detergent surfactant to be added, as indicated by logic block 300, to the dishwasher solution container (not shown) to start the washing operation of a dishwasher load including articles having proteinaceous soil. The microprocessor then begins a timing operation, as indicated by logic block 302. The microprocessor then causes a solution softener chemical to be added to the solution container, as indicated by logic block 304. Softener is added until the wash water solution has been softened, whereupon no more softener is added to the wash water solution, as indicated by decisional logic block 306. A suitable process and apparatus for measuring and modifying the hardness of the wash water solution using sodium tripolyphosphate as the softener chemical is described in commonly assigned U.S. Pat. No. 4,334,881 issued June 15, 1982 entitled "Method and Apparatus for Automatic End-Point Detection in Tripolyphosphate of Sequestration of Hardness."

The microprocessor is programmed next to perform the process of the present invention. The first step in the process is shown in dotted line designated 307 during which silicate is added to the wash water solution, as indicated by logic block 308, until the pH of the wash water solution is raised to a preselected first pH value, for example, 10.45, which is slightly less than a target pH value in the range of 10 to 11, for example 10.50. The target pH value is somewhat arbitrarily selected for the process depending upon what the programmer having ordinary skill in the art of dishwashing decides is appropriate for the removal of proteinaceous soil within a pH range of 10 to 11 that will be effective to solubilize the protein.

Once the first pH value has been reached, the process goes to the following step shown in dotted line designated 311 in which the microprocessor under program control causes a control signal to be provided to an alkali and bleach dispenser, causing both (which may be alkaline-built bleach) in small amounts to be added to the wash water solution, as indicated by logic block 312. As the alkali and bleach are added to the wash water solution, the pH electrode is providing pH measured value signals to microprocessor 110 such that when the pH reaches the target pH value, for example, 10.50, alkali and bleach are no longer added, as indicated by decisional logic block 314. Periodic pH checks are then made by microprocessor 110 at preselected intervals after the pH value has been raised to the target pH value to determine whether other operational steps should be taken.

Specifically, when a time lapse of more than one hour has occured since the first introduction of alkali and bleach (logic block 308), as indicated by decisional logic block 318, microprocessor 110 is programmed to provide a control signal to a wash water solution drain, as indicated by logic block 320, causing the wash water solution to be drained from the solution container and the next step of the wash process to be started, as indicated by logic block 322. The reason is that if the process has not eliminated the proteinaceous soil within an hour there is something extraordinary occuring and it is unreasonable to continue the process. The one hour time is arbitrarily set by the programmer.

In the event that the time lapse has been less than one hour, microprocessor 110 is programmed to check to determine if more than ten minutes has lapsed since the last addition of a preselected amount of bleach to the solution, as indicated by decisional logic block 324. If more than ten minutes has lapsed, microprocessor 110 then provides a control signal to drain 320, causing the wash water solution to be drained from the solution container and the next washing step to be begun.

However, if ten minutes or less has lapsed, microprocessor 110 then checks to determine whether the value of the wash water solution pH has dropped less than 0.02 pH units but below a preselected value, for example, 10.49, as indicated by decisional logic block 326. If the pH has not dropped below the preselected 10.49 value, microprocessor 110 then repeats the periodic pH check, as indicated by logic block 316, and then repeats the process through logic blocks 318; 324 and 326 as discussed above. If, however, the pH value has dropped below 10.49 which would be a drop of 0.02 pH units, microprocessor 110 then is programmed to cause additional preselected amounts of alkali and bleach (which may be alkaline-built bleach) to be added to the wash water solution, as indicated by logic block 312, until the pH value reaches the target pH value of 10.50, as indicated by decisional logic block 314. Thus, when the pH drops 0.02 units (below the preselected value of 10.49), microprocessor 110 is programmed to repeat the process through logic blocks 312 and 314 discussed above until the pH is raised to the target pH value of 10.50, whereupon microprocessor 110 then makes a periodic pH check, as indicated by decisional logic block 316.

It should be noted that the apparatus in FIGS. 1 and 2 can be programmed so as to perform variations of the process of the present invention. The circuitry used to provide the digital bit stream having a bit rate in accordance with the measured pH value of the wash water solution could take any number of different forms. The disclosed apparatus is thus illustrative and in no way should be construed as limiting the process of the present invention.

Without further elaboration, it is believed that one skilled in the art can, using the preceding description, utilize the present invention to its fullest extent. The following examples are illustrative of the substantial improvement in proteinaceous soil removal achieved in the process of the present invention and are not limitative of the remainder of the disclosure in any way whatsoever.

EXAMPLE 1

In this example, sodium silicate was the alkali used in the first step of that process to raise the pH of the wash water solution to the value of 10.45, which was slightly less than the target pH value being used. The hypohalite was hypochlorite having a concentration of 50,000 milligrams per liter (mg/l) available chlorine. Sodium silicate was also present in the hypochlorite solution. A base-line test using no hypochlorite produced an average percent soil removal (gravimetric) of 46.8. The results of the process in accordance with this invention were as follows:

| | Average Percent Proteinaceous Soil Removal (Gravimetric) |
|---|---|
| pH 10.5 | 95.7 |
| pH 10.7 | 97.7 |
| pH 10.9 | 97.6 |
| 30 g/l silicate | 96.3 |
| 40 g/l silicate | 97.6 |
| 50 g/l silicate | 97.1 |
| 1:1 ratio ($SiO_2$:$Na_2O$) | 96.2 |
| 1.3:1 ratio ($SiO_2$:$Na_2O$) | 97.1 |
| 1.6:1 ratio ($SiO_2$:$Na_2O$) | 97.8 |

EXAMPLE 2

In the test listed below, the sodium silicate was 1.3:1 ratio of $SiO_2$:$Na_2O$, at 40 g/l.

| | Average Percent Proteinaceous Soil Removal (Gravimetric) |
|---|---|
| 5,000 mg/l available $Cl_2$ | 85.4 |
| 25,000 mg/l available $Cl_2$ | 96.7 |
| 50,000 mg/l available $Cl_2$ | 97.4 |

As the two examples above show, the process of the present invention results in a substantial increase in the removal of proteinaceous soil from objects being washed.

As the example below shows, by keeping the level of the hypohalite in the wash water solution below the level which causes detrimental effects, the process of the present invention can produce this substantial improvement in proteinaceous soil removal without resulting in adverse effects to the objects being cleaned that are made of plastic, sterling silver and aluminum.

COMPARATIVE EXAMPLE

Companion soil-free tests were run using the same total amount of alkaline-built hypochlorite bleach (110 ml of 5.25% sodium hypochlorite, 0.78M in KOH). In the first test, the addition of the alkaline-built bleach to the wash water solution was made in a single charge at the beginning of the washing operation. This test resulted in a discoloration to a chocolate brown of the sterling silver objects and a white corrosion product associated with pitting on the aluminum objects.

In the second test, the same total amount of alkaline-built bleach was added to the wash water solution, but the addition was made at a set rate so as to cover an entire 20-minute wash period. While the metal attack was less drastic than in the first case, neither the effect on the plastic, sterling silver nor the aluminum objects would be acceptable to a consumer. This latter test shows that merely adding the hypochlorite to the wash water solution at a controlled rate through the entire wash period is not a satisfactory alternative to the process of the present invention, where hypochlorite is added only when called for by the continued presence of protein soil.

Companion comparison tests were run, using ten grams of dry milk solids as a protein source. Much diminished adverse effects were observed (compared to the no-soil tests) when the addition of alkaline-built bleach was made as a single charge at the beginning of the wash period. No adverse effects were observed when the addition was made over the entire twenty-minute wash period.

These two sets of companion tests show that slow, incremental addition is better than a single addition. They also show that, in the presence of protein soil, adverse side effects can be avoided, using the process of the present invention.

While the specific embodiment and method of this invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. In a process for washing soiled articles bearing proteinaceous soil with a wash water solution, the improvement of reacting proteinaceous soil and hypohalous halogen to solubilize the proteinaceous soil by controlling the amount of hypohalous halogen added to the wash water solution based on monitoring the pH of the wash water solution and stopping the addition of hypohalous halogen when the proteinaceous soil is substantially all solubilized comprising:

(a) first adding alkali to the wash water solution to bring the pH thereof to slightly below a selected target pH value in the range of 10 to 11;

(b) then adding to the wash water solution 5 to 50 milligrams of hypohalous halogen per liter of wash water solution and sufficient alkali to raise the pH of the wash water solution to the target pH value;

(c) tracking the reaction between proteinaceous soil and hypohalous halogen by monitoring the pH of said wash water solution for a drop in pH of at least 0.02 pH units occuring after the addition of the hypohalous halogen; and (d) either terminating the addition of hypohalous halogen if no such drop in the pH occurs or repeating steps (b) and (c) until the 0.02 pH units drop is no longer detected in step (c), thereby ensuring substantially complete reaction with the proteinaceous soil.

2. The process of claim 1, wherein the hypohalous halogen is supplied by hypohalite bleach.

3. The process of claim 2, wherein the hypohalite bleach is hypochlorite bleach.

4. The process of claim 1, wherein in step (a), an amount of alkali is added as required to bring the pH of the wash water solution to between 10.3 and 10.8.

5. The process of claim 1, wherein the alkali is sodium metasilicate.

6. The process of claim 1, wherein the alkali and hypohalous halogen are added together as a mixture to the wash water solution.

7. The process of claim 6, wherein the alkali and the hypohalous halogen are present in the mixture in a ratio equivalent to about a 1:1 KOH:NaOCl molar ratio.

8. The process of claim 1, wherein in step (b), about 15 to 20 milligrams of hypohalous halogen is added per liter of wash water solution.

9. The process of claim 1, wherein said soiled articles are dishes with food residues on them.

10. The process of claim 1:

wherein the hypohalous halogen is supplied by hypochlorite bleach, wherein the alkali is sodium metasilicate, wherein the alkali and said hypochlorite bleach are added together as a mixture to the wash water solution, and wherein in step (b), an amount of hypochlorite bleach is added which supplies from about 15 to 20 milligrams of hypohalous halogen per liter of wash water solution.

11. A process for washing dishes with proteinaceous food residues on them in a wash water solution, the improvement of reacting proteinaceous soil and hypochlorite bleach to solubilize the proteinaceous soil by controlling the amount of hypochlorite bleach added to the wash water solution based on monitoring the pH of the wash water solution and stopping the addition of hypochlorite bleach when the proteinaceous soil is substantially all solubilized comprising the steps of:

(a) first adding alkali to the wash water solution in an amount required to bring the pH value of the wash water solution to a preselected initial pH value between about 10.0 and 10.3;

(b) then adding hypochlorite bleach containing sodium metasilicate in an amount equivalent to about a 1:1 KOH:NaOCl molar ratio to the wash water solution in an amount which raises the pH value of the wash water solution at least 0.02 units to a pH value between about 10.4 and 10.5;

(c) tracking the reaction between proteinaceous soil and hypochlorite bleach by monitoring the pH value of said wash water solution for a drop in pH value at least 0.02 units occuring after the addition of said bleach; and (d) either terminating the addition of said bleach if no such drop in the pH occurs or repeating steps (b) and (c) until a drop of 0.02 units in pH value is no longer detected in step (c), thereby ensuring substantially complete reaction of said bleach with the proteinaceous soil.

* * * * *